US010960569B2

(12) United States Patent
Grenier et al.

(10) Patent No.: US 10,960,569 B2
(45) Date of Patent: Mar. 30, 2021

(54) PLANER HEAD

(71) Applicant: DK-SPEC INC., Saint-Nicolas (CA)

(72) Inventors: Guillaume Grenier, Scott (CA); Antoine McNeil, Levis (CA); Guillaume Aubé, St-Augustin-de-Desmaures (CA); Clermont Levasseur, St-Antoine de Tilly (CA)

(73) Assignee: DK-SPEC INC., Saint-Nicolas (CA)

( * ) Notice: Subject to any disclaimer, the term of this patent is extended or adjusted under 35 U.S.C. 154(b) by 160 days.

(21) Appl. No.: 16/400,884

(22) Filed: May 1, 2019

(65) Prior Publication Data

US 2020/0346362 A1 Nov. 5, 2020

(51) Int. Cl.
*B27G 13/04* (2006.01)
*B27C 1/02* (2006.01)

(52) U.S. Cl.
CPC ..... *B27G 13/04* (2013.01); *B27C 1/02* (2013.01)

(58) Field of Classification Search
CPC ..... B27G 13/02; B27G 13/04; B27G 13/08; B27G 13/10; B27C 1/005; B27C 1/007; B27C 1/02; B27C 1/04; B27C 1/06; B27C 1/08; B27L 11/005; B27L 11/02; B27L 11/04; B27L 11/06; B27L 11/08; B02C 18/06; B02C 18/18; B02C 18/182; B02C 18/184; B02C 18/186
See application file for complete search history.

(56) References Cited

U.S. PATENT DOCUMENTS

| | | | | | |
|---|---|---|---|---|---|
| 5,558,142 | A * | 9/1996 | Ehrle | B27G 13/10 | 144/218 |
| 5,658,101 | A * | 8/1997 | Hammer | B02C 18/186 | 407/33 |
| 5,800,079 | A * | 9/1998 | Qvarth | B23C 5/2226 | 144/230 |
| 6,095,210 | A * | 8/2000 | Parks | B27G 13/04 | 144/218 |
| 6,386,250 | B1 * | 5/2002 | Liu | B27G 13/04 | 144/229 |
| 7,182,112 | B2 * | 2/2007 | Meados | B27C 1/02 | 144/117.1 |
| 2015/0059925 | A1 * | 3/2015 | Levasseur | B27G 13/04 | 144/230 |

* cited by examiner

*Primary Examiner* — Matthew Katcoff
(74) *Attorney, Agent, or Firm* — Morgan, Lewis & Bockius LLP

(57) ABSTRACT

A device for processing wood and other material is described. A planer head, typically used in wood processing, has a cylindrical body which rotates around an axis and comprises one or multiple cutting knives. The knives are held in place by a knife holder. The knife holder is placed in the cylindrical body by insertion into holes in the cylindrical body and held in place through a fastening assembly comprised of a long and slender fastening member with a threaded end.

30 Claims, 14 Drawing Sheets

PLANER HEAD

BACKGROUND

To manufacture plain wood lumbers, freshly cut wood logs undergo a series of transformations. Typically, the bark is first removed, then the cross-section of the wood log is transformed from a rounded shape to a cruciform shape. This shape transformation optimizes the number of wood lumbers that can be extracted from a given wood log. In a further step, wood lumbers are cut out of each of the cruciform shaped wood logs, and finally, the surfaces of the wood lumbers are trimmed to reduce roughness and splinters, and to obtain a consistent thickness throughout the length of the lumber.

The trimming step is generally carried out using one or more planer heads. A planer head has the general configuration of a large rotating wheel provided with a plurality of knives extending outwardly from its circumference. When a lumber passes about a planer head in rotation, the knives take off an outside layer of the wood lumber (typically a ¼ or ½ inch layer) thereby trimming and smoothing its surface. In most prior art configurations, the planer head includes a generally cylindrical body having a centrally disposed bore coinciding with an axis of rotation of the planer head (which is also its longitudinal axis). The body is plain and typically made of machined steel and includes a plurality of knife pockets radially disposed and uniformly distributed on a crenelated curved face defining the circumference of the body.

The knife pockets each include a first wall, and a second wall spaced apart and opposing the first wall. The first wall can be scalloped, while the second wall is substantially flat. Each of the knife pockets is configured to receive a corresponding knife and a knife holder for holding the knife into position during the operation of the planer head.

Each knife includes a connection portion receivable in a knife pocket to connect to the body, and a cutting edge extending from the connection portion to trim the wood lumbers when the planer head is rotated about its axis of rotation.

Knife holders are typically radial members that collaborate with a fastening mechanism to retain the knives onto the body.

As will be appreciated by those skilled in the art, this planer head configuration suffers many drawbacks. One is the installation of bolts or other fastening means on the circumference of the planer head to fasten the knife holder. This arrangement results in significantly less area available for installation of knives. Since knives realize the function of the machine, this can result in lower throughput as well as lower quality of finish in the product being processed by the planer head. Furthermore, a planer head with a large width may require a plurality of fastening means (e.g. nuts and bolts) for each knife and knife holder. This makes maintenance and adjustment of a knife and knife holder a more involved process for the machine operator.

Therefore, there is a need for a planer head that will overcome at least one of the above-identified drawbacks.

BRIEF SUMMARY

According to a broad aspect, there is provided a planer head comprising:

a cylindrical body having a rotational axis, the cylindrical body including at least one knife pocket on the periphery of the body having a first wall, a second wall and a bottom wall, the cylindrical body further including at least one bore extending parallel to the rotational axis, and at least one hole extending between the bottom wall of the pocket and the at least one bore, at least one knife holder having a first wall, a second wall adjacent to the second wall of the knife pocket, a bottom wall, and at least one protrusion projecting away from the bottom wall of the at least one knife holder, the at least one protrusion being configured to engage the at least one hole of the cylindrical body and to partially extend into the bore, the knife holder being moveable in the knife pocket between a radially inward position and a radially outward position, at least one knife received in the knife pocket of the cylindrical body, the at least one knife having a first wall adjacent to the first wall of the at least one knife pocket, a second wall adjacent the first wall of the at least one knife holder and a cutting edge extending radially away from the knife pocket, and a fastening assembly for fastening the at least one knife holder to the cylindrical body, the fastening assembly including a longitudinal member and a fastening means, the longitudinal member being sized and shaped to fit within the bore of the cylindrical body and including a first end, a second end and at least one slot located between the first end and the second end, the at least one slot being shaped to interact with the at least one protrusion of the knife holder extending in the bore of the cylindrical body, the fastening means of the fastening assembly engaging the first end of the longitudinal member to force the longitudinal member from a released position toward a locked position, wherein when the longitudinal member is forced from the released position toward the locked position, the at least one slot of the longitudinal member engages the at least one protrusion of the knife holder to urge movement of knife holder from the radially inward position to the radially outward position, wherein the knife holder in the radially outward position secures the at least one knife to the cylindrical body.

According to another broad aspect, there is provided a kit of a planer head assembly comprising:

a cylindrical body having a rotational axis, the cylindrical body including at least one knife pocket on the periphery of the body having a first wall, a second wall and a bottom wall, the cylindrical body further including at least one bore extending parallel to the rotational axis, and at least one hole extending between the bottom wall of the pocket and the at least one bore, at least one knife holder having a first wall, a second wall adjacent to the second wall of the knife pocket, a bottom wall, and at least one protrusion projecting away from the bottom wall of the at least one knife holder, the at least one protrusion being configured to engage the at least one hole of the cylindrical body and to partially extend into the bore, the knife holder being moveable in the knife pocket between a radially inward position and a radially outward position, at least one knife receivable in the knife pocket of the cylindrical body, the at least one knife having a first wall adjacent to the first wall of the at least one knife pocket, a second wall adjacent the first wall of the at least one knife holder and a cutting edge extending radially away from the knife pocket, and a fastening assembly for fastening the at least one knife holder to the cylindrical body, the fastening assembly including a longitudinal member and a fastening means, the longitudinal member being sized and shaped to fit within the bore of the cylindrical body and including a first end, a second end and at least one slot located between the first end and the second end, the at least one slot being shaped to interact with the at least one protrusion of the knife holder extending in the bore of the cylindrical body, the fastening means of the fastening assembly being engageable to the first end of the longitudinal member to force the longitudinal member from a released position toward a locked position, wherein when the longitudinal member is forced from the released position toward the locked position, the at least one slot of the longitudinal member engages the at least one protrusion of the knife holder to urge movement of knife holder from the radially inward position to the radially outward position, wherein the knife holder in the radially outward position secures the at least one knife to the cylindrical body.

In one feature, the at least one protrusion comprises a first end adjacent the bottom wall of the knife holder and a second end extending into the at least one bore of the cylindrical body.

In another feature, the second end of the at least one protrusion comprises a tapered end. Alternatively, the second end of at least one protrusion comprises a parabolically shaped end.

In yet another feature, the cylindrical body comprises three holes extending between the bottom wall of the at least one knife pocket and the bore and the knife holder comprises three protrusions configured to engage the three holes of the cylindrical body and to partially extend into the bore. In this feature, the longitudinal member comprises three slots configured to engage the three protrusions extending in the bore of the cylindrical body.

In another feature, the cylindrical body further comprises a mounting hole for mounting the body to a rotating shaft, the mounting hole extending along the rotational axis at a center of the cylindrical body.

In yet another feature, the longitudinal member comprises a shaft and a threaded portion extending at the first end of the longitudinal member. In this feature, the fastening means comprises a nut engaging the threaded portion of the longitudinal member.

In a further feature, the bore of the cylindrical body comprises a first end, a second end and a circular recess at the first end of the bore. The circular recess of the bore receiving the threaded portion of the longitudinal member and the nut engaging the threaded portion.

In still a further feature, the shaft of the longitudinal member has a first longitudinal axis, and the threaded portion of the longitudinal member has a second longitudinal axis, the second longitudinal axis of the threaded portion being offset in a radial direction from the first longitudinal axis of the shaft.

In yet a further feature, the bore has a third longitudinal axis and the circular recess has a fourth longitudinal axis, the fourth longitudinal axis the circular recess being offset relative to the third longitudinal axis of the bore in a radial direction, wherein when the longitudinal member is positioned in the bore, the second longitudinal axis of the threaded portion of the longitudinal member aligns with the fourth longitudinal axis of the circular recess.

In another feature, the longitudinal member further comprises a flange extending radially at the second end thereof.

In still another feature, the bore of the cylindrical body further comprises a second recess at the second end of the bore, the second recess of the bore receiving therein the flange extending at the second end of the longitudinal member. Preferably, the flange at the second end of the elongated member and the second recess at the second end of the bore have an oblong shape.

In yet another feature, the planer head comprises between 20 and 40 knife pockets and a corresponding number of knives and knife holders. Preferably, the planer head comprises 24 knife pockets and a corresponding number of knives and knife holders.

Additional and/or alternative features, aspects, and advantages of embodiments of the present will become apparent from the following description, the accompanying drawings, and the appended claims.

Additional and/or alternative features, aspects, and advantages of embodiments of the present will become apparent from the following description, the accompanying drawings, and the appended claims.

BRIEF DESCRIPTION OF THE DRAWINGS

For a better understanding of the present, as well as other aspects, and further features thereof, reference is made to the following description which is to be used in conjunction with the accompanying drawings, where:

FIG. 100 is another enlarged right side view of the portion of the planer head shown in FIG. 1, showing all knives and knife holders fastened and positioned;

DETAILED DESCRIPTION

Figure 1:
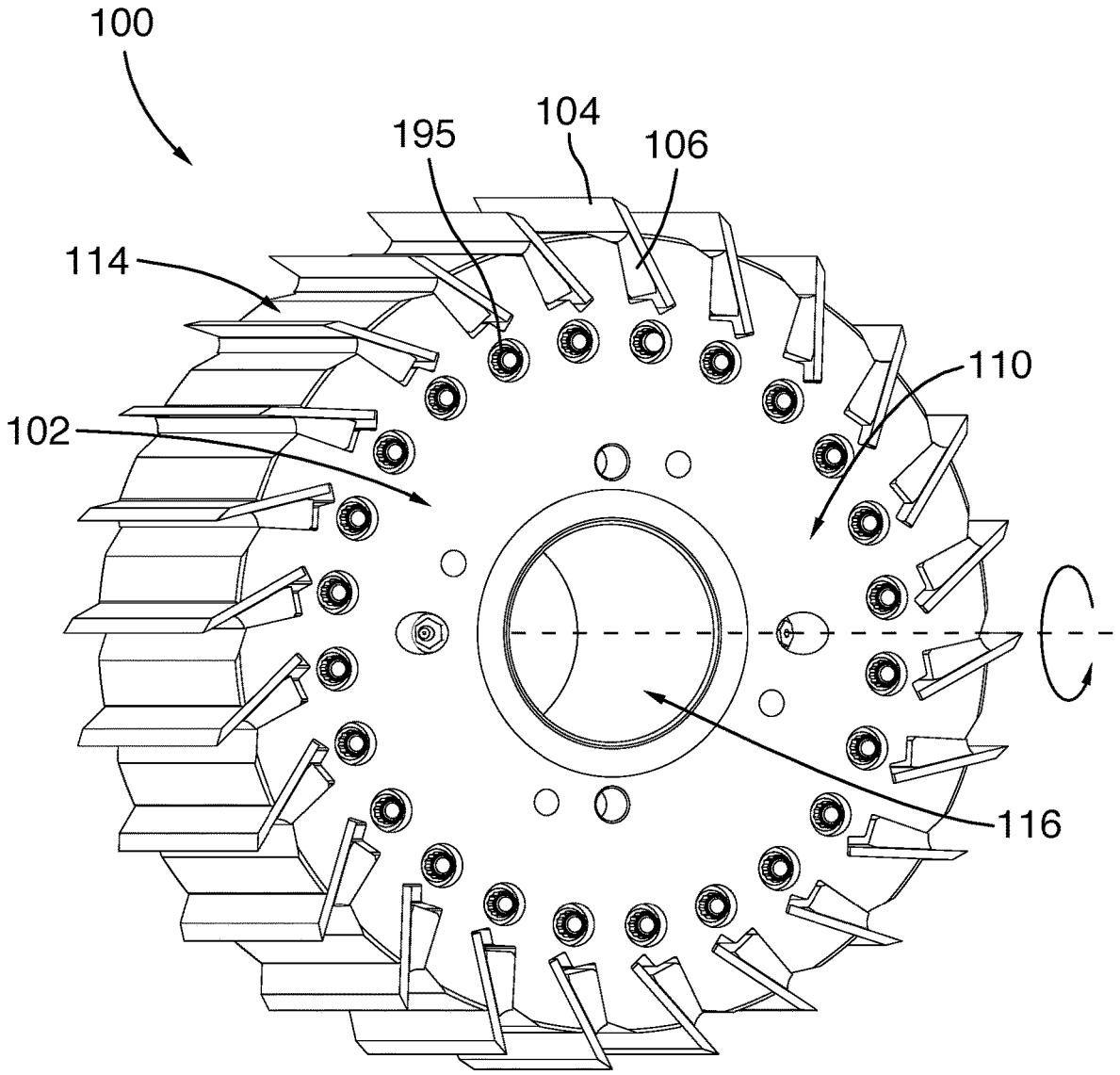
FIG. 1 is a right perspective view of a planer head according to a first embodiment.

Referring to FIGS. 1 to 11B, an embodiment of a planer head 100 will be described. In this embodiment, the planer head 100 includes a body 102, a plurality of knives 104 and a corresponding plurality of knife holders 106. The planer head 100 also comprises a corresponding plurality of fastening assemblies 108, each fastening assembly 108 including a longitudinal member 193 with a threaded portion 215 and nut 195. Each fastening assembly 108 collaborates with a corresponding knife holder 106 for securing one knife 104 to the body 102 (only some knives 104 and knife holders 106 being identified with reference numerals).

In the illustrated embodiment, the planer head 100 includes twenty-four knives 104, twenty-four knife holders 106 and twenty-four fastening assemblies 108. It is however contemplated that the planer head 100 could comprise a different number of knives 104, corresponding knife holders 106 and fastening assemblies 108. For instance, the planer head 100 could comprise one or more knives 104, knife holders 106 and fastening assemblies 108. In one embodiment, the planer head 100 could comprise between ten and sixty knives 104, knife holders 106 and fastening assemblies 108, and preferably between twenty and forty knives 104, knife holders 106 and fastening assemblies 108.

Figure 2:
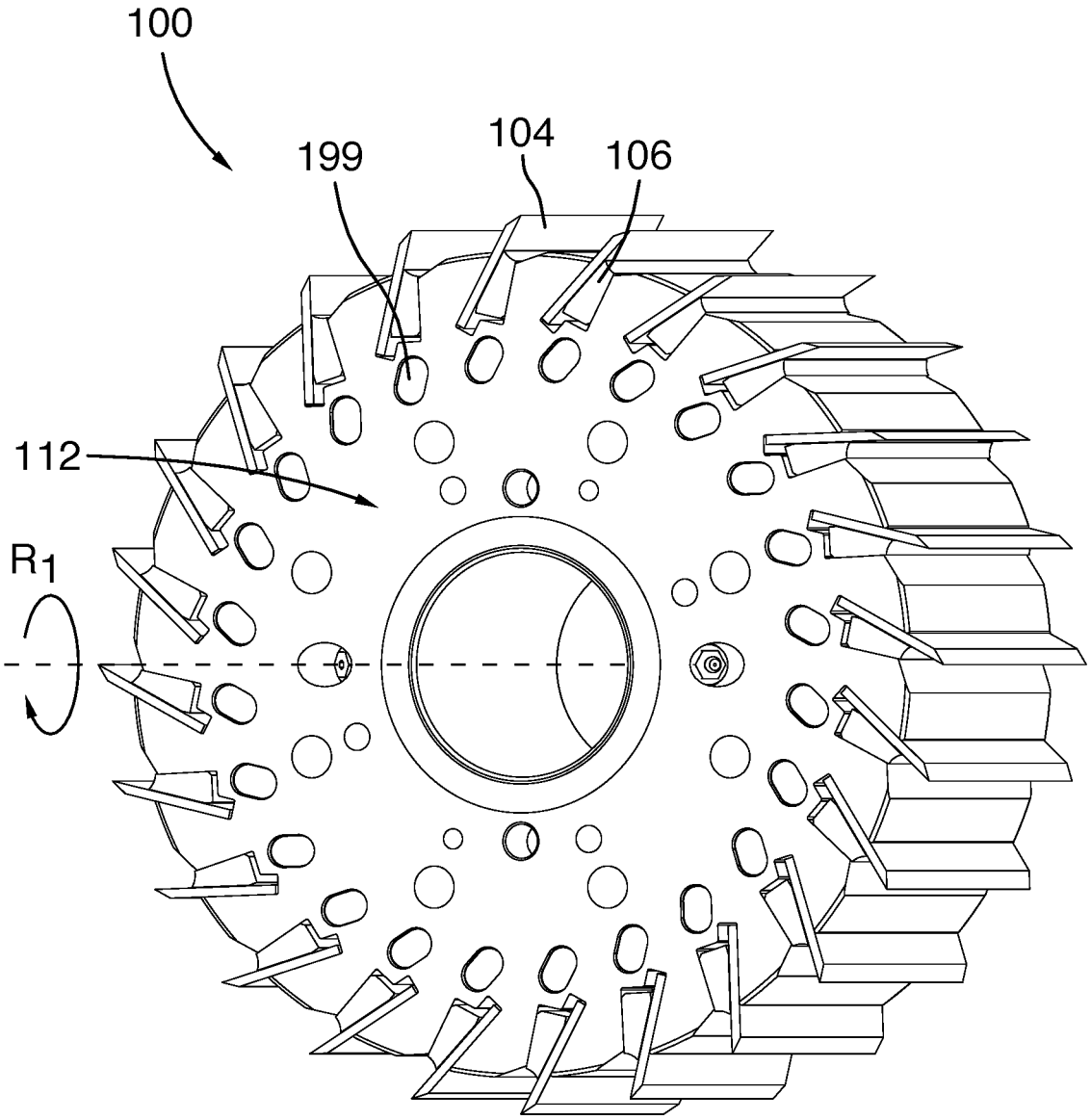
FIG. 2 is a left perspective view of the planer head shown in FIG. 1.
Figure 3:
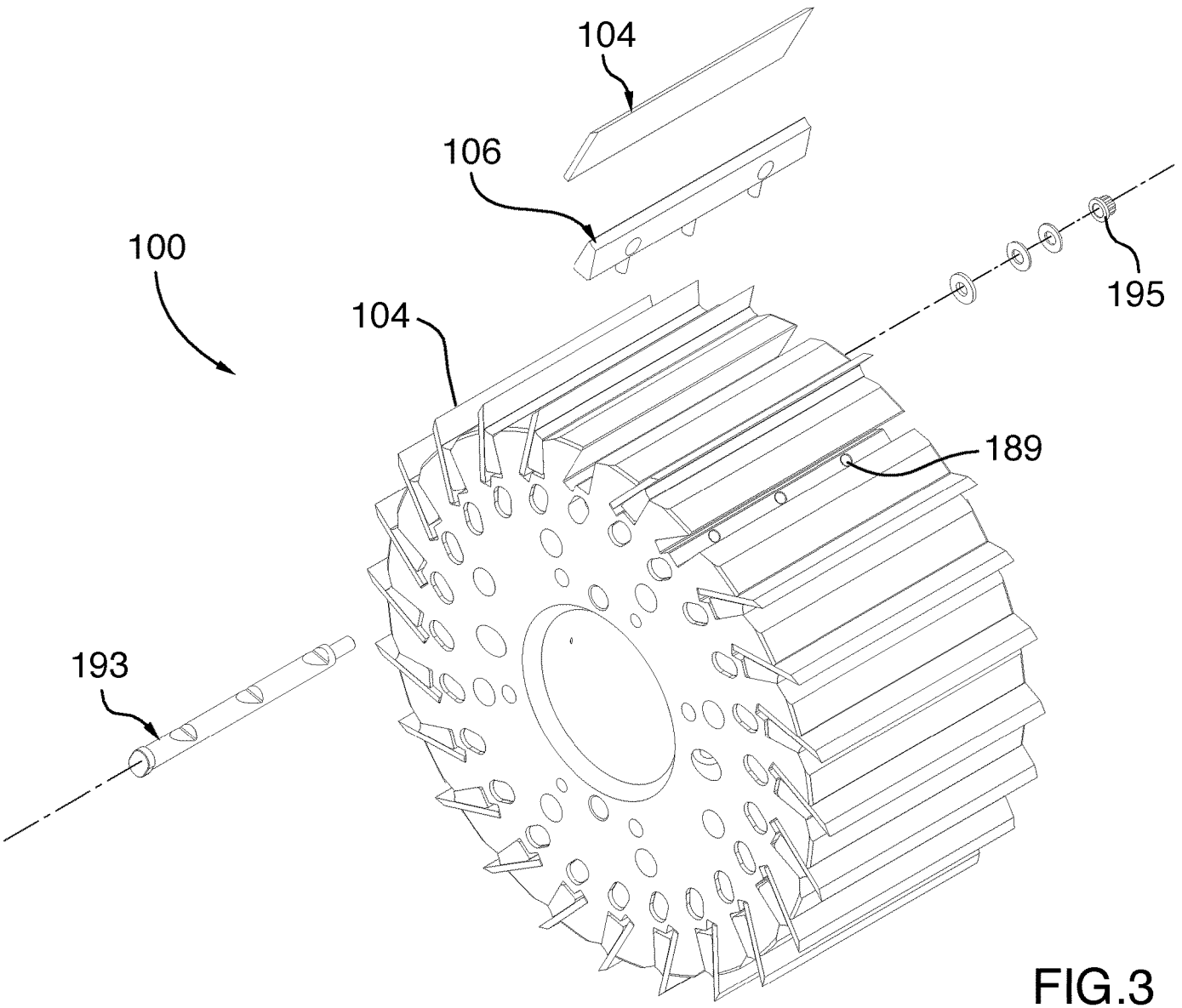
FIG. 3 is a right perspective, partially exploded view of the planer head shown in FIG. 1.

With reference to FIGS. 1 and 2, the body 102 is generally cylindrical and has a generally circular right end 110, a generally circular left end 112 and a crenelated curved face 114 extending between the right end 110 and the left end 112 and defining the circumference of the body 102. The body 102 is preferably made of machined steel. The body 102 has a centrally disposed bore 116 extending between the right end 110 and the left end 112 for mounting the planer head 100 on a rotating shaft (not shown), for rotation about an axis of rotation $R_1$.

Figure 9:
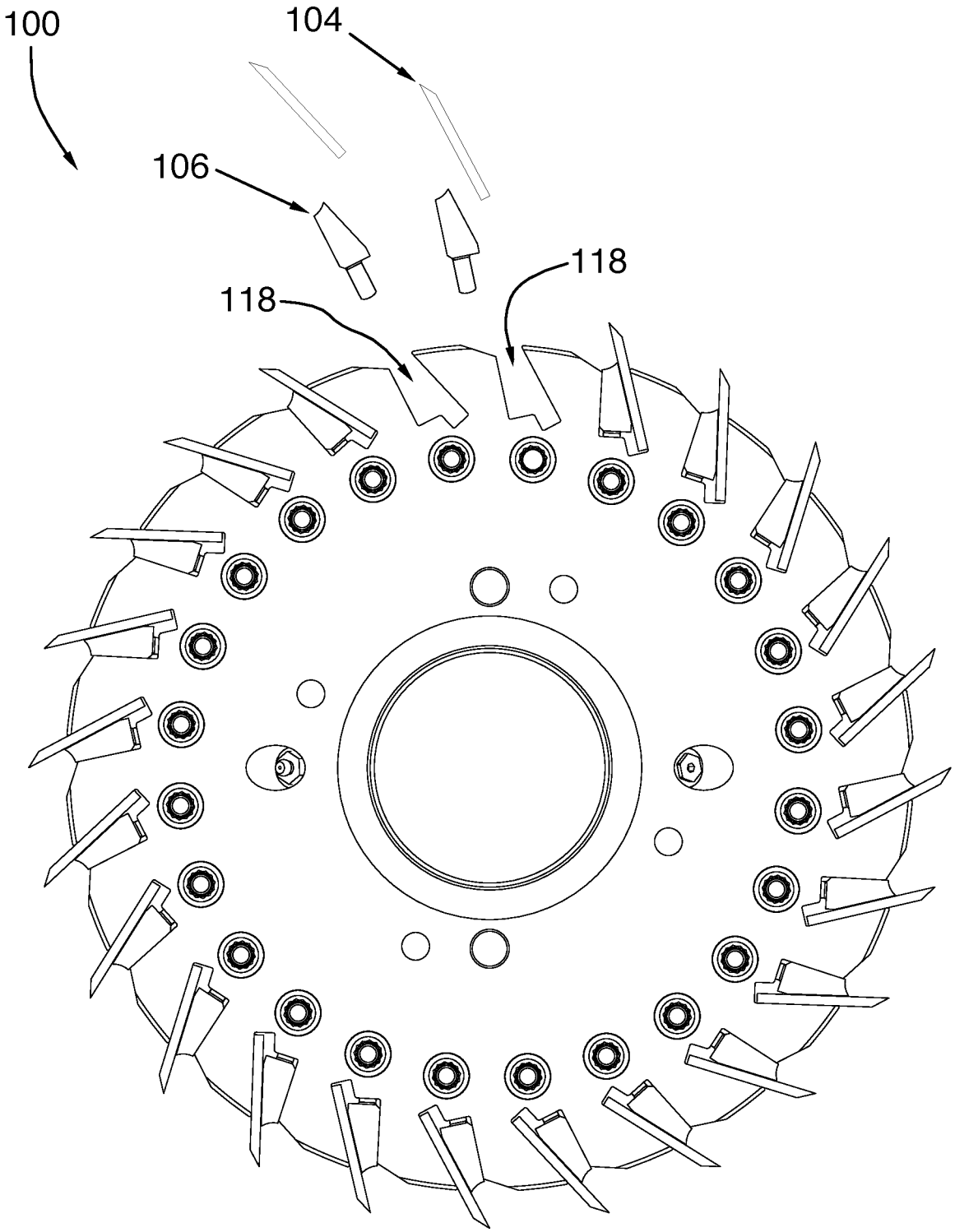
FIG. 9 is a right view of the cylindrical body, knife holders and knives of the planer head shown in FIG. 1, with two knife holders and two knives removed.
Figure 10A:
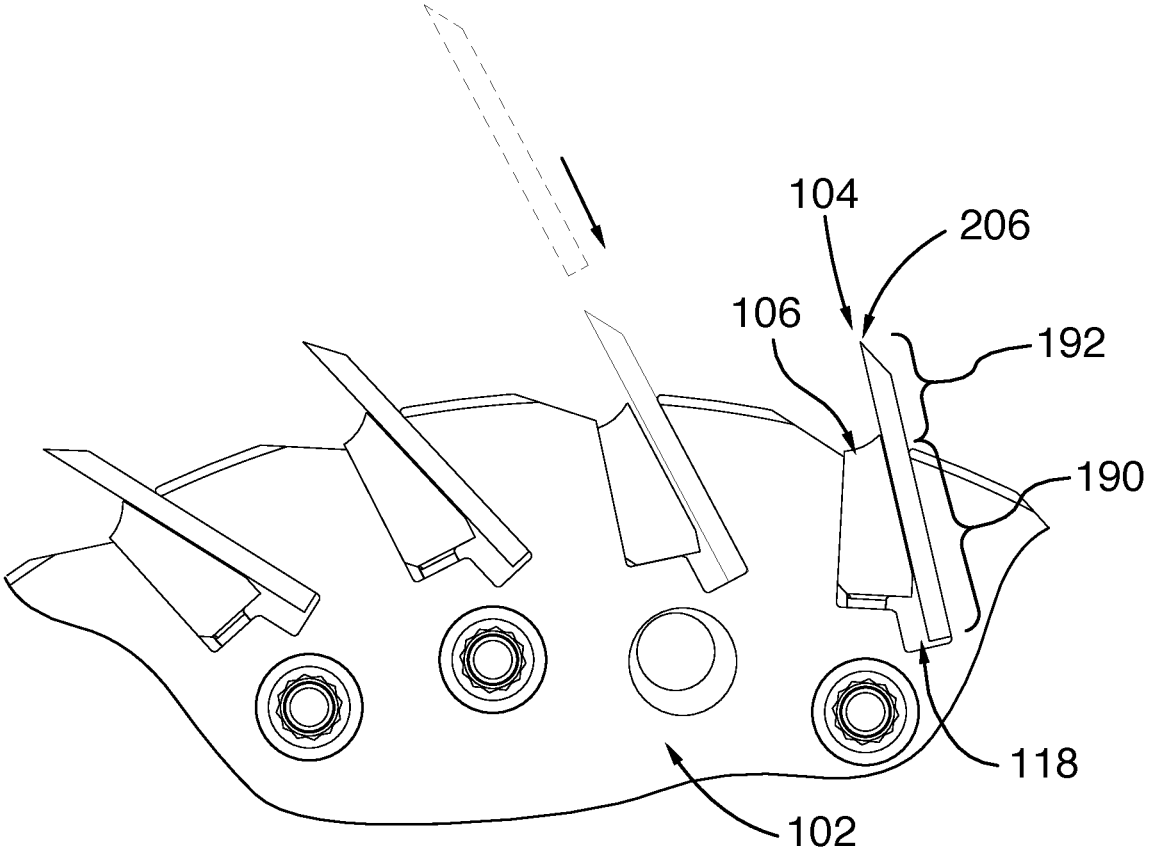
FIG. 10A is an enlarged right side view of a portion of the planer head shown in FIG. 1, showing one knife and knife holder prior to being fastened and positioned.
Figure 10B:
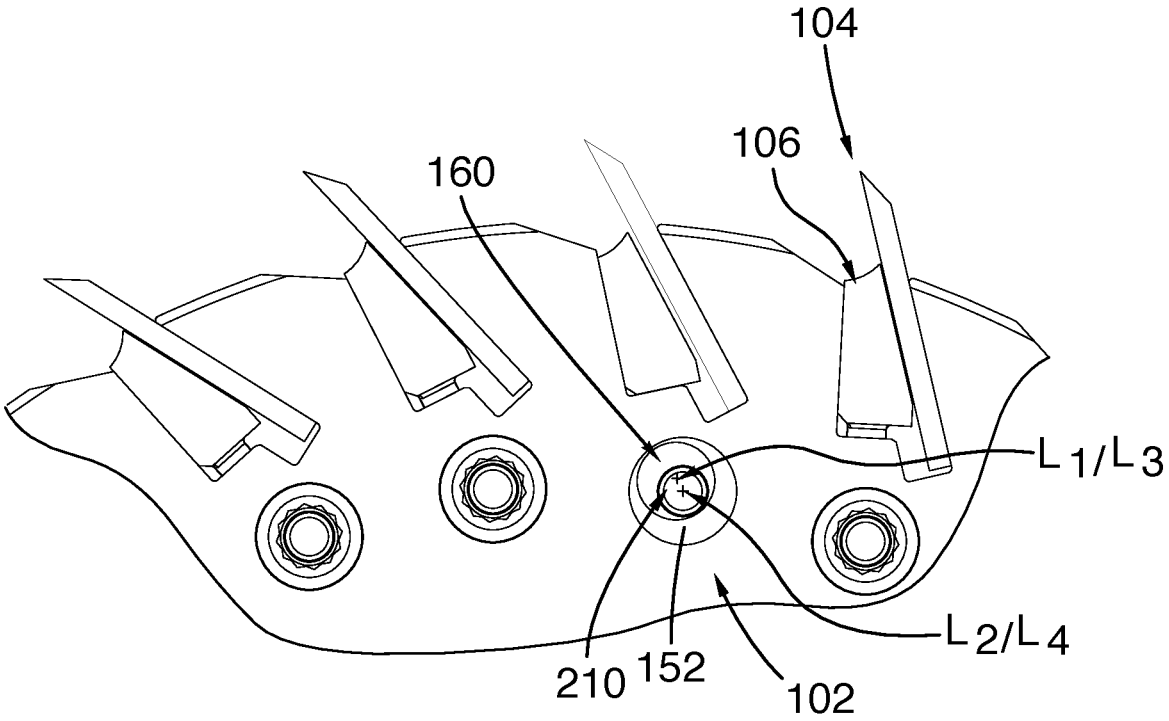
FIG. 10B is another enlarged side view of a portion of the planer head shown in FIG. 1, showing one knife and knife holder with a part of the fastening assembly in place.
Figure 10C:
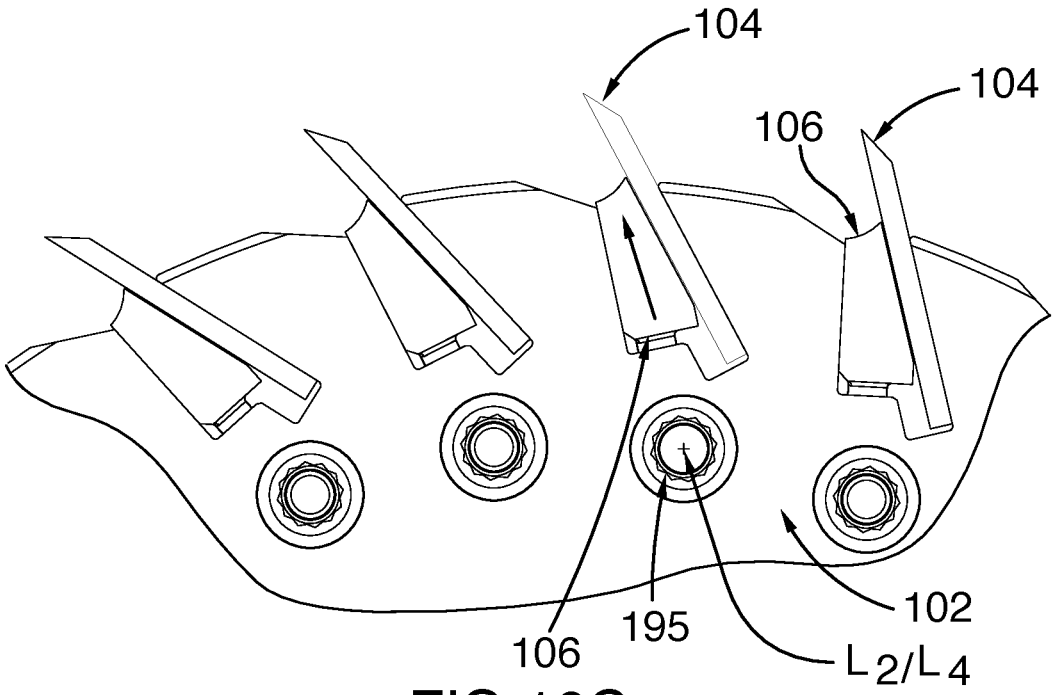
Figure 11A:
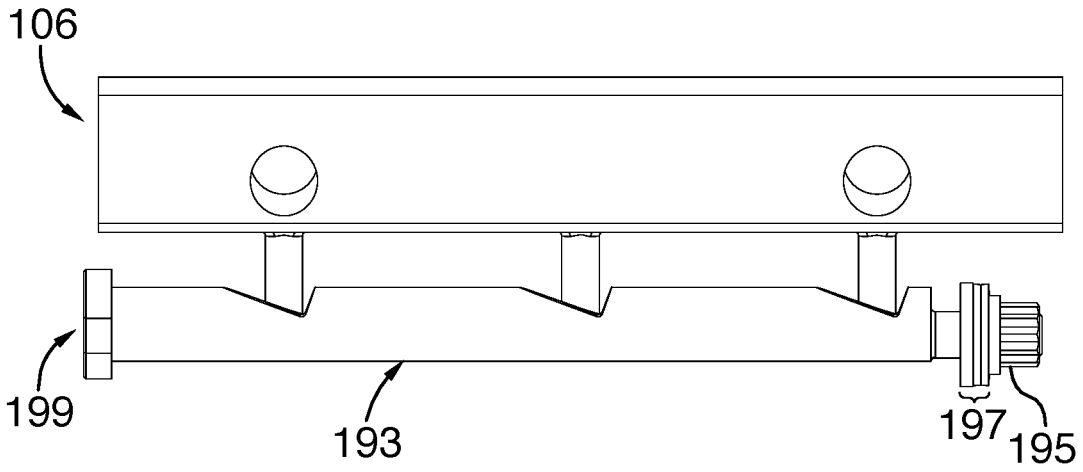
FIG. 11A is an illustration of a fastening assembly and a knife holder prior to fastening.
Figure 11B:
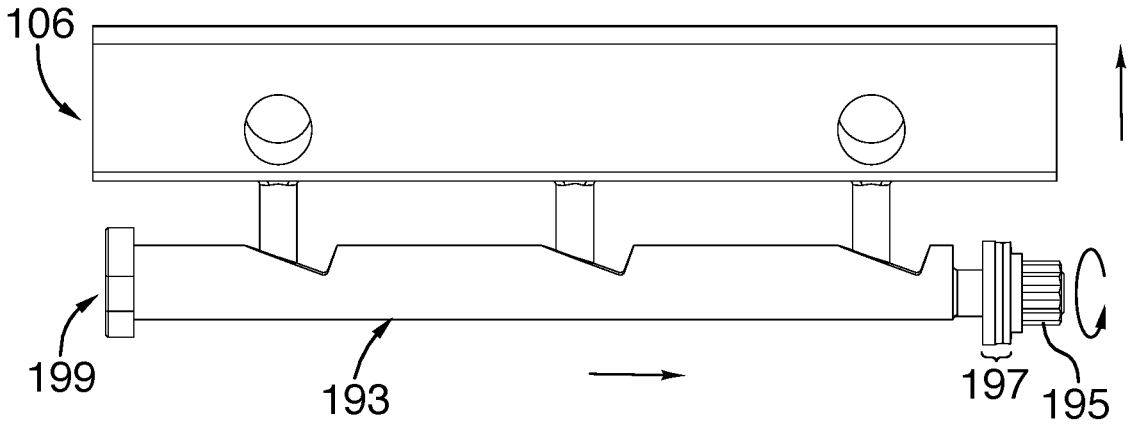
FIG. 11B is an illustration of the fastening mechanism and knife holder shown in FIG. 11A, after fastening.

The body 102 includes a plurality of knife pockets 118 disposed on the curved face 114 (best shown in FIG. 9). In the embodiment shown, the body includes twenty-four knife pockets 118. The person skilled in the art will appreciate that the number of knife pockets 118 could be different, and that the number of such knife pockets 118 will define the number of knives 104 and knife holders 106 mountable to the body 102. The knife pockets 118 are uniformly spaced apart (i.e. distributed) along the crenelated curved face 114 or circumference of the body 102.

Each knife pocket 118 is sized and shaped to receive a corresponding knife 104 and a corresponding knife holder 106 therein. Each knife pocket comprises a lower receiving portion 120 and an upper receiving portion 122 (shown in FIG. 4A). The lower and upper receiving portions 120, 122 share a common front wall 124, which is forwardly angled at an angle $\theta_1$ relative to a radius extending from the rotation axis $R_1$ to the bottom end 129 of the front wall 124 (see FIG. 4A). The lower receiving portion 120 is also provided with a back wall 126, spaced apart from the front wall 124 and extending parallel thereto, as well as a bottom wall 128 extending between the front wall 124 and the back wall 126 and perpendicular thereto, at the bottom ends 129, 131 thereof.

The upper receiving portion 122 of the knife pocket 118 comprises a back wall 130 having a top end 132 and a bottom end 134. The back wall 130 is forwardly angled at an angle $\theta_2$ relative to a radius extending from the rotation axis $R_1$ to the bottom end 134. As one can appreciate from FIG. 4A, the angle $\theta_2$ is smaller than the angle $\theta_1$, and therefore the top end 127 of the front wall 124 converges toward the back wall 130, at an angle $\theta_3$, to define somewhat of a funneled shaped knife pocket 118 (see FIG. 9). While in the illustrated embodiment, the front and back walls 124, 126 and 130 are generally flat, it is contemplated that in an alternative embodiment at least one of them could be scalloped to increase frictional engagement with the knife 104 and knife holder 106.

Extending between the bottom end 134 of the back wall 130 and the bottom end 131 of the back wall 126 of the lower receiving portion 120 is a knife holder resting wall 136. The knife holder resting wall 136 extends perpendicular to the back wall 130 and provides support to the knife holder 106 received in the knife pocket 118, as it will become apparent below.

As it will be appreciated, a portion of the body 102 extends generally radially between each pair of adjacent knife pockets 118. Together, the knife pockets 118 therefore define a plurality of knife retaining members 138, each retaining member 138 comprising a trailing face 140 (corresponding to the back walls 126 and 130 of a first knife pocket 118), a leading face 142 (corresponding to the front wall 124 of the adjacent knife pocket 118) and a backwardly and upwardly angled top face 144 extending between the trailing face 140 and the leading face 142. Each knife retaining member 138 also includes lower portion 146 extending from the bottom wall 128 of the lower portion 120 to a junction $J_1$, as well as an upper portion 148 extending from the junction $J_1$ to the top face 144 of the retaining member 138.

Figure 4A:
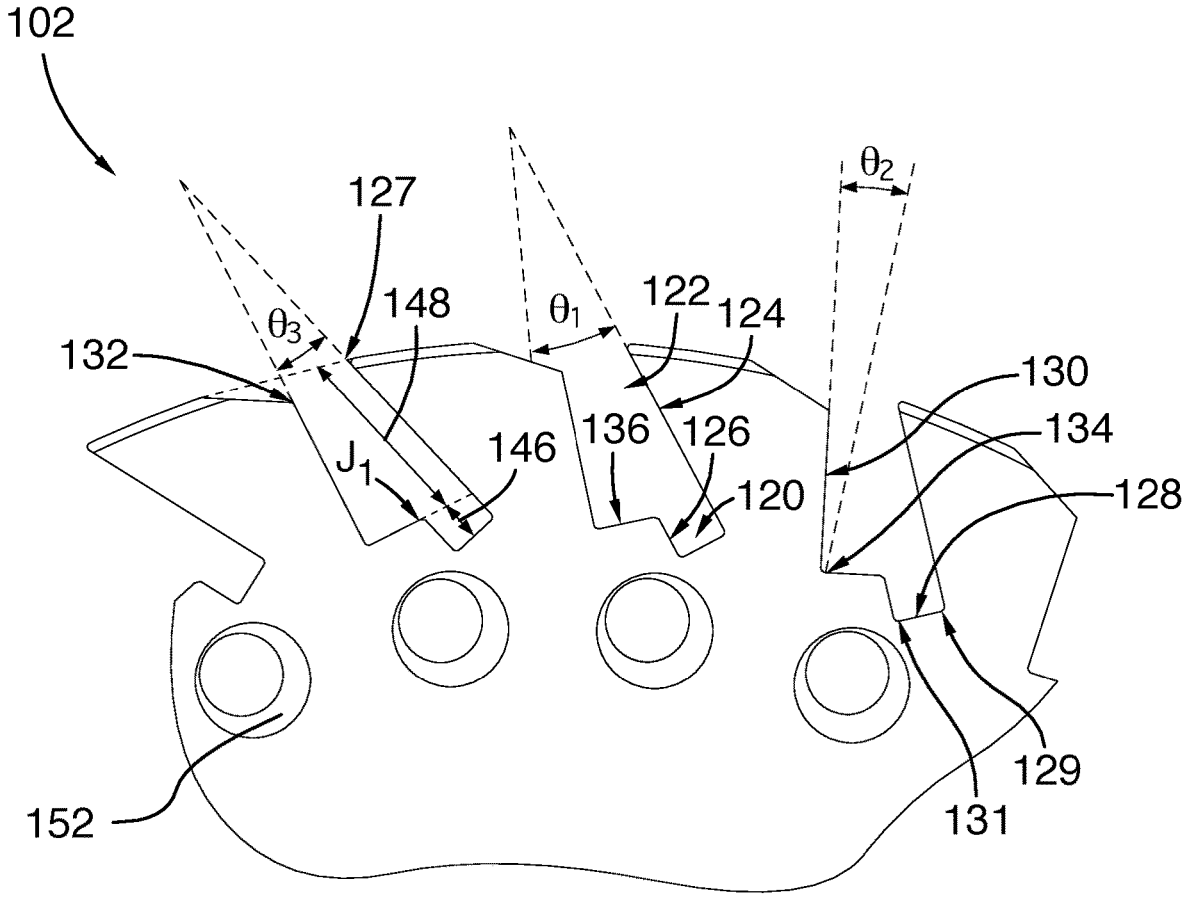
FIG. 4A is an enlarged, partial right view of the cylindrical body of the planer head shown in FIG. 1.
Figure 4B:
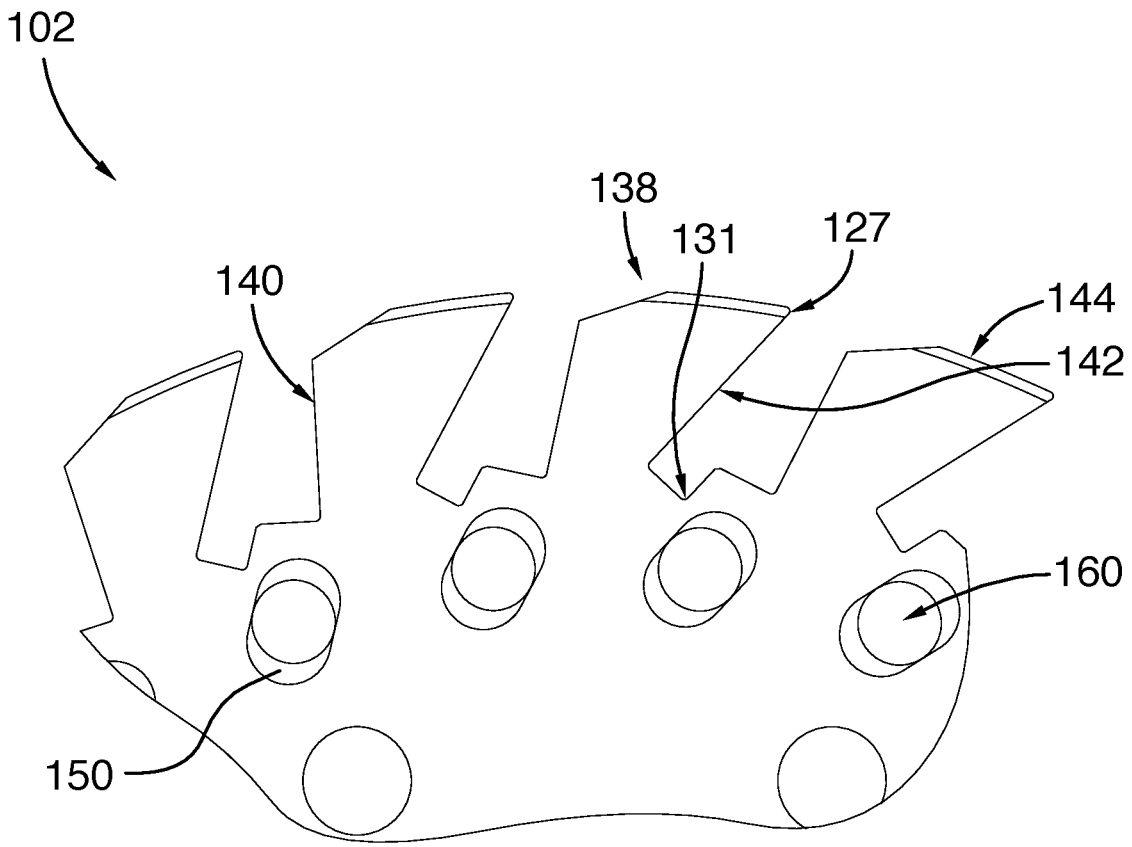
FIG. 4B is an enlarged, partial left view of the cylindrical body shown in FIG. 4A.

Extending longitudinally between the right and left ends 110, 112 is a plurality of bores 160 for receiving therein the corresponding plurality of fastening assemblies 108 to secure the knife holder 106, as it will become apparent below. The bores 160 are pathways with a circular cross section. On the right end 110, the body is provided with a plurality of circular recesses 152, one recess 152 being adjacent to each bore 160. As best shown in FIG. 4A, the circular recess 152 is offset or eccentric relative to the bore 160. On the left end 112, the body 102 is provided with a plurality of oblong recesses 150, one oblong recess being adjacent to each bore 160. As it will become apparent below, the configuration of the circular recesses 152 and oblong recesses 150 collaborate with the fastening assemblies 108 to ensure proper positioning of the fastening assemblies 108 relative to the body 102, to ensure proper fastening of the knife holders 106.

Extending between each bore 160 and the knife holder resting wall 136 of a corresponding knife pocket 118 is a plurality of holes 189. As it will become apparent below, the holes 189 are sized, shaped and positioned to receive therein a corresponding plurality of protrusions 186 projecting from a knife holder 106 received in the knife pocket 118, the protrusions 186 extending in a corresponding bore 160 to be engaged by a corresponding fastening assembly 108.

Figure 5A:
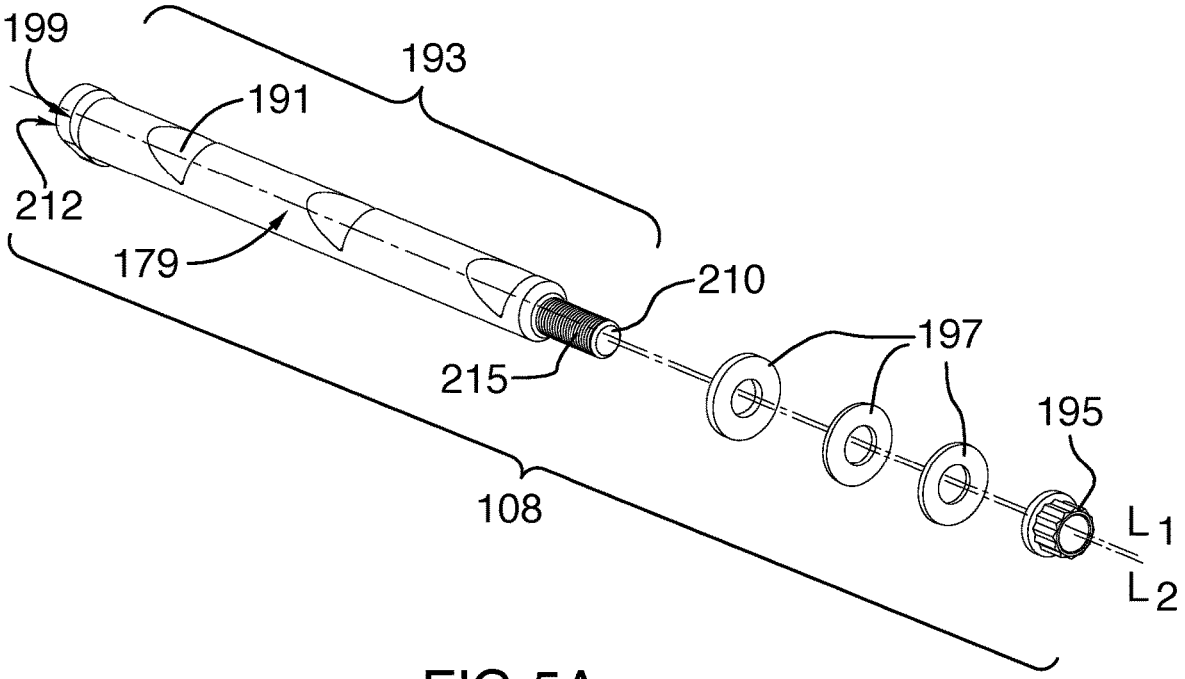
FIG. 5A is a perspective view of a fastening assembly for the planer head shown in FIG. 1.
Figure 5B:
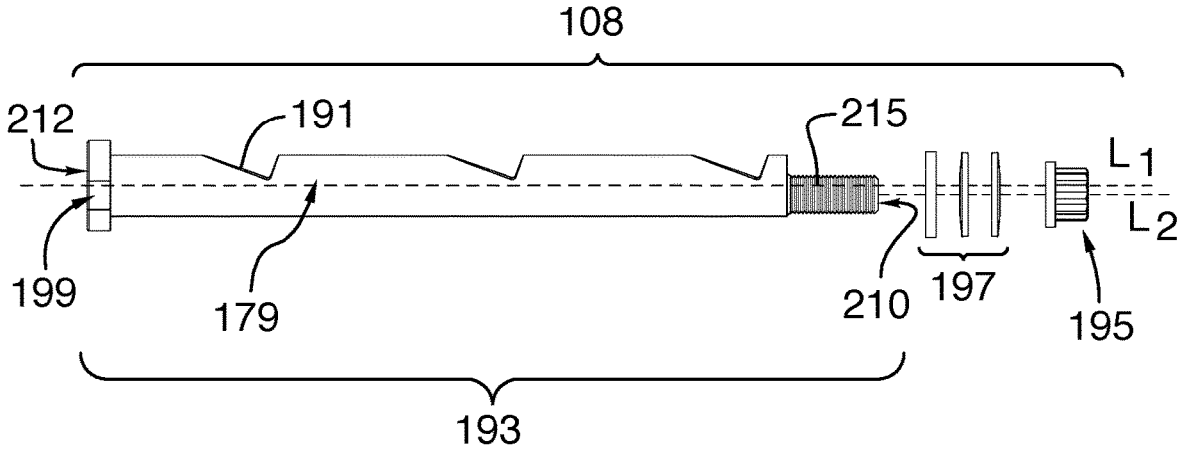
FIG. 5B is a front view of the fastening assembly shown in FIG. 5A.
Figure 6A:
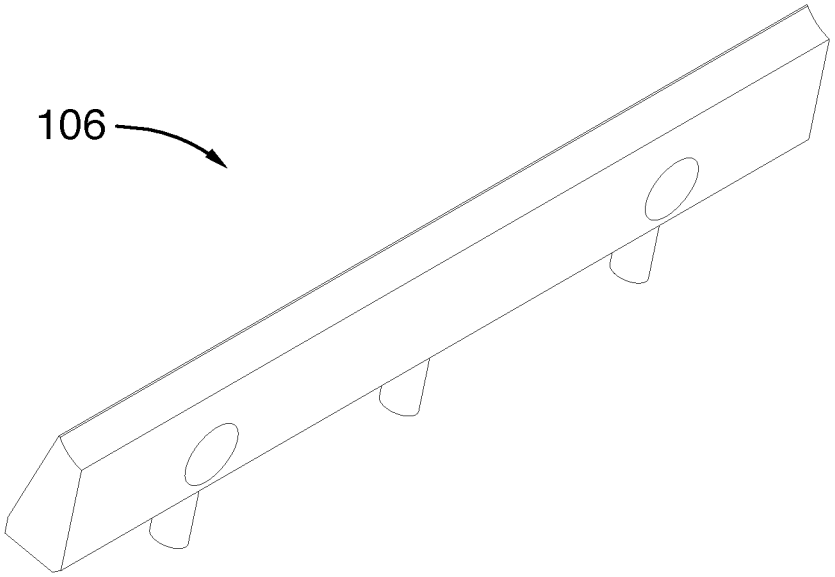
FIG. 6A is a back left perspective view of a knife holder for the planer head shown in FIG. 1.
Figure 6B:
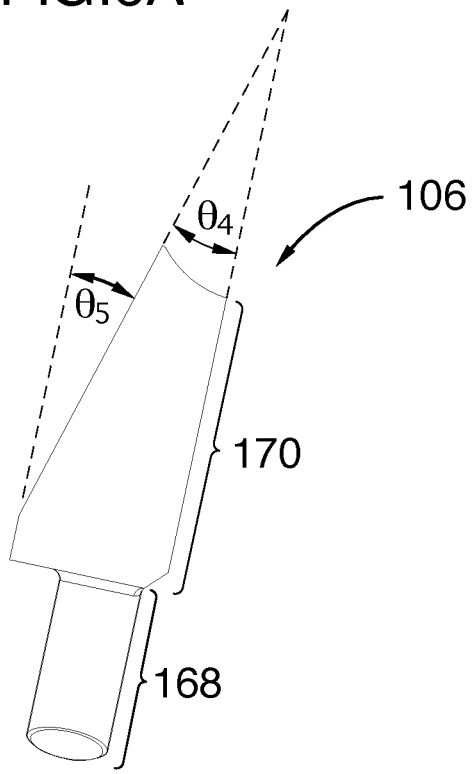
FIG. 6B is a side view of the knife holder shown in FIG. 6A.
Figure 6C:
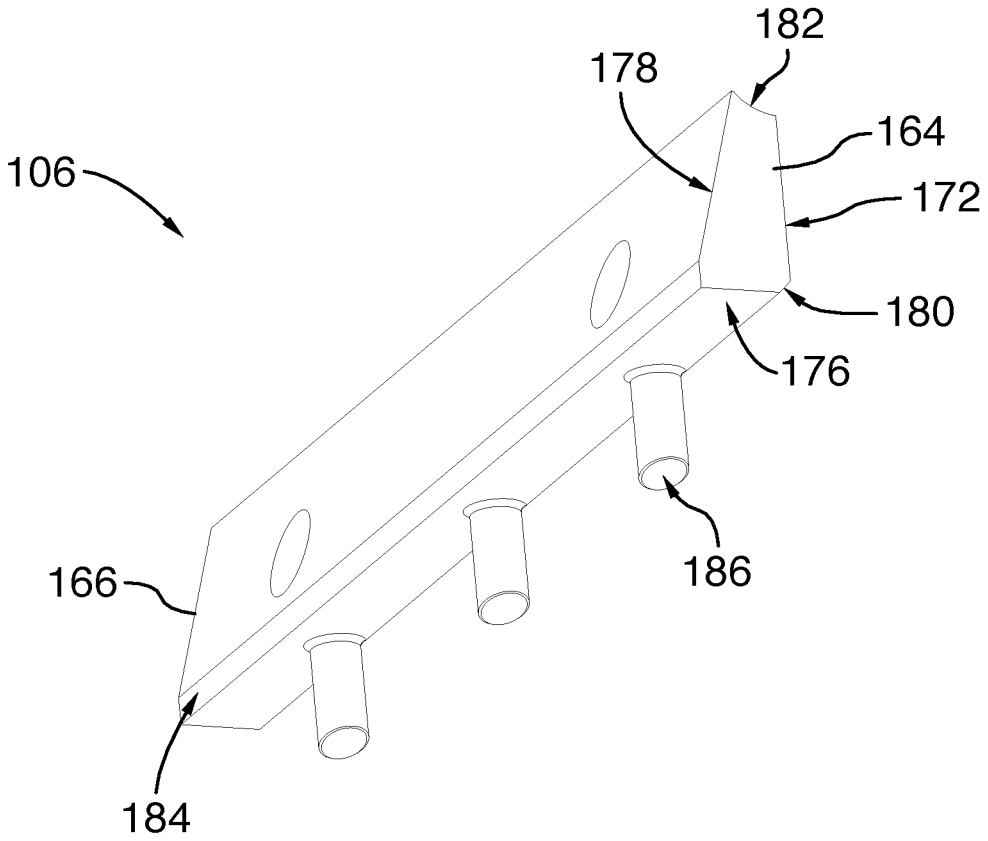
FIG. 6C is a front left perspective view of the knife holder shown in FIG. 6A.
Figure 6D:
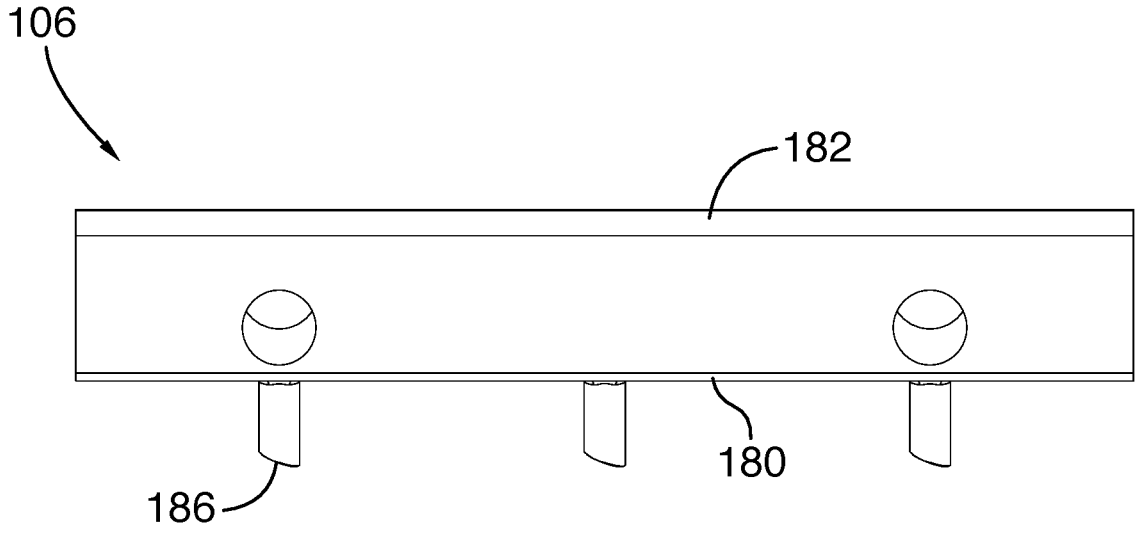
FIG. 6D is a front view of the knife holder shown in FIG. 6A.

Turning now to FIGS. 5A to 5B, a fastening assembly 108 will now be described in accordance with one embodiment. In this embodiment, the fastening assembly comprises a longitudinal member 193 comprising a left end 212, and a right end 210. Moving from the right end 210 toward the left end 212, the longitudinal member 193 comprises a threaded portion 215, a main shaft 179 and an oblong flange 199 projecting radially from the main shaft 179. The main shaft 179 is sized and shaped to be received in the bore 160, while the threaded portion 215 is configured to project in the circular recess 152 of body 102. As best shown in FIG. 5B, the threaded portion 215 of the longitudinal member 193 is cylindrical and has a smaller diameter than the main shaft 179, its longitudinal axis $L_2$ being offset relative to a longitudinal axis $L_1$ of the main shaft 179. The threaded portion is sized and shaped to receive a plurality of washers 197 (in the illustrated embodiment, three washers) and a nut 195. Defined on the main shaft 179 of the longitudinal member 193 is a plurality of cuneal slots 191 positioned to be in registry with the holes 189 of the body 102 and to receive therein the protrusions 186 of the knife holder 106 when the fastening assembly 108 is in place in the body 102.

Although the slots are only found on one side in the preferred embodiment, other forms are possible without deviating from the invention. For example, an alternative embodiment may include slots spanning the circumference of the longitudinal member.

The longitudinal axis $L_1$ of the main shaft 179 aligns with a longitudinal axis $L_3$ of the bore 160. The longitudinal axis $L_2$ of threaded portion 215 aligns with a longitudinal axis $L_4$ of the recess 152 (see FIGS. 10B and 8). This allows the threaded portion 215 to be fastened to the body 102 using nut 195 only when $L_2$ is centered in the recess 152. This arrangement ensures that the cuneal slots 191 are in position to engage with the protrusions 186 of the knife holder 106 during assembly.

On the left end 212 of the longitudinal member 193, the oblong flange 199 is sized and shaped to be received in the oblong recess 150 of the body. As it will become apparent below, the shape of the oblong lip, as well as the configuration of the threaded portion 215 of the longitudinal member 193, together with the oblong recess 150 and the circular recess 152 of the body 102, respectively, ensure that the longitudinal member 193 is properly positioned in the bore 160 for ensuring proper interaction with protrusions 186 of the knife holder 106.

Although a fastening mechanism has been described above per the preferred embodiment of the invention, the person skilled in the art will appreciate that other fastening means are possible. As a non-limiting example, a pin and lever type fastening mechanism or a different form of a threaded fastener may be used.

Turning now to FIGS. 6A to 6D, the knife holders 106 will be described in accordance with one embodiment. In this embodiment, each knife holder 106 has a longitudinal oriented slender body having a right end 164 and a left end 166. The knife holder 106 further comprises a lower portion 168 comprising three protrusions 186 sized and shaped to be received in holes 189 in the knife holder resting wall 136 and cuneal slots 191 in the longitudinal member 193. Although in this embodiment the knife holder 106 comprises three cylindrical protrusions 186 to engage a corresponding plurality of holes 189, it will be understood that the body 102 and knife holder 106 could include a different number of holes 189 and corresponding protrusions 186. Furthermore, it will be appreciated that the holes 189 and protrusions 186 could have other shapes provided that the protrusions 186 can be received in the holes 189 to engage cuneal slots 191. For example, the protrusions 186 may have parabolically shaped ends with the cuneal slots 191 shaped accordingly to receive them. The slots may have a linear or nonlinearly shaped slope. Alternatively, the protrusions 186 and holes 189 may have a rectangular or another non-circular cross section.

The knife holder 106 further comprises an upper portion 170, sized and shaped to be received in the upper receiving portion 122 of the corresponding knife pocket 118. The upper portion 170 of the knife holder 106 includes a trailing face 172 configured to abut the back wall 140 of the knife pocket 118, a bottom face 176 extending between a chamfered edge 180 and a surface 184. There is an angle $\theta_4$ as measured between the trailing face 172 and the leading face 178 and the surface 184 is set at an angle $\theta_5$ to the leading face 178. Extending between the trailing face 178 of the upper portion 170, and the trailing face 172, at the upper end thereof, is a curved top face 182. At the bottom end of the trailing face 172 is a chamfered edge 180, while at the opposite side at the bottom end of the leading face 178, is a surface 184 set at an angle $\theta_5$ to the leading face 178.

The person skilled in the art will understand that the knife holder may be manufactured as one part or may be assembled together. For example, it's possible to manufacture the upper portion 170 separate from the lower portion 168 in order to reduce material waste. The protrusions 186 can be attached to the upper portion 170 through welding or other methods well known in the art. Alternatively, the protrusions 186 can remain unattached to the upper portion 170, having one end in contact with the upper face 170 and another end in contact with the longitudinal member 193 when the planer head 100 is assembled.

Figure 7A:
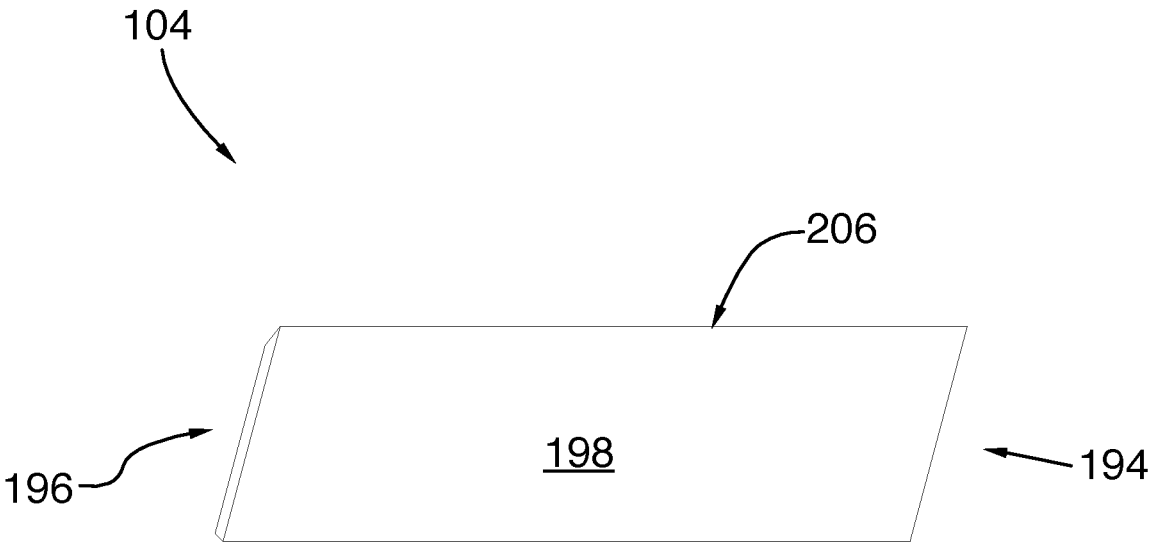
FIG. 7A is a front view of a knife for the planer head shown in FIG. 1.
Figure 7B:
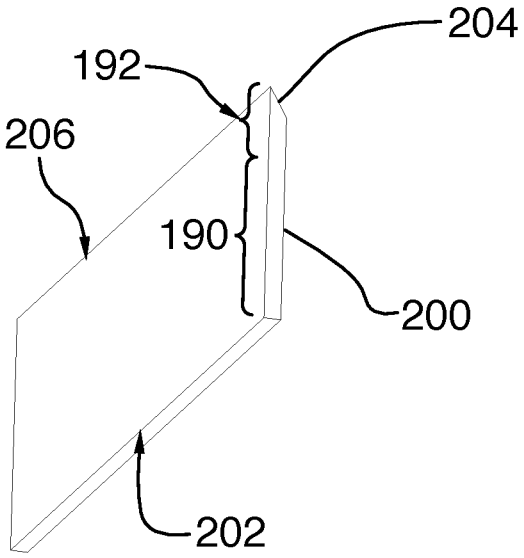
FIG. 7B is a front right perspective view of the knife shown in FIG. 7A.
Figure 8:
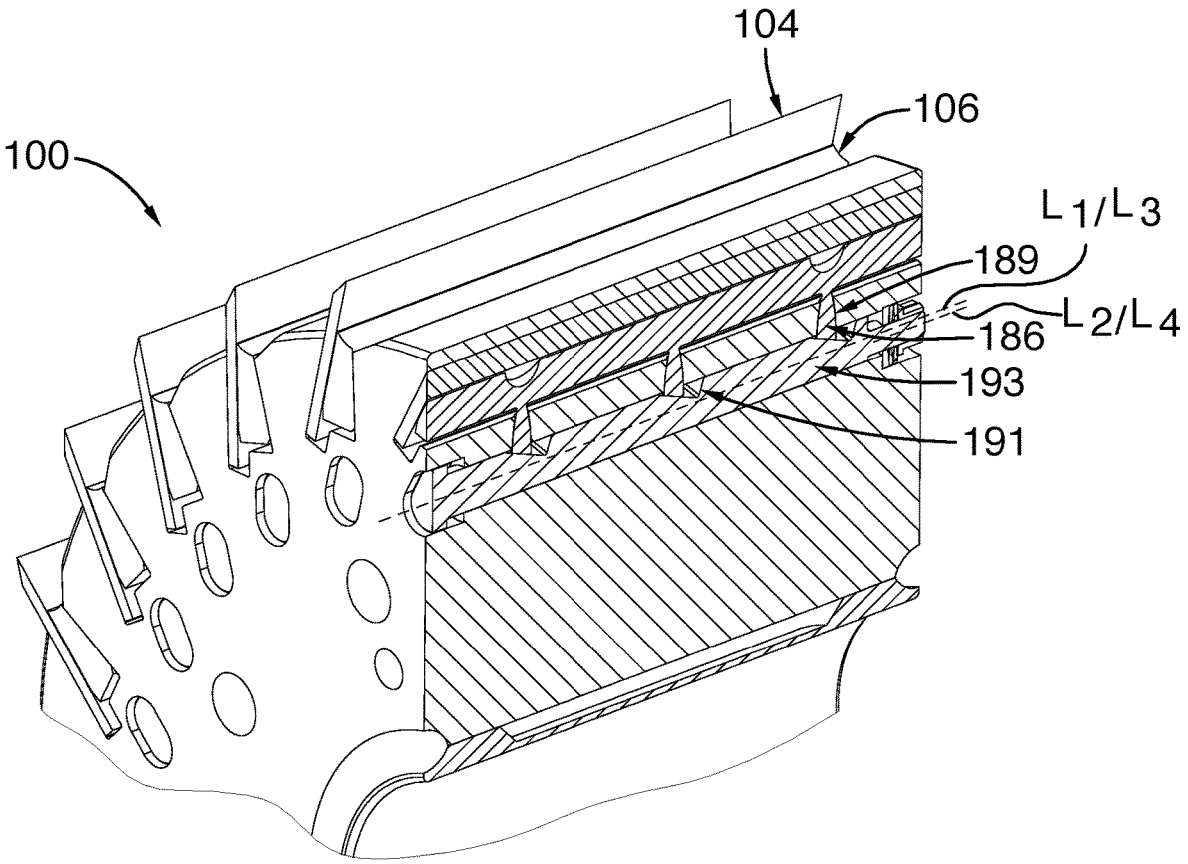
FIG. 8 is an enlarged, longitudinal cross-section view of the planer head shown in FIG. 1.

With reference to FIGS. 7A and 7B, each knife 104 has the general shape of a rectangular plate and comprises a connection portion 190 receivable in a corresponding knife pocket 118 and a cutting portion 192 extending therefrom. Each knife 104 has a right end 194, a left end 196, as well as a leading face 198 and a parallel trailing face 200 extending therebetween. Extending perpendicularly to the leading and trailing faces 198, 200, at the lower end thereof, is a bottom face 202, while a top face 204 extends angularly (upwardly and forwardly) from the upper end of the trailing face 200 toward the upper end of the leading face 198 to define a cutting edge 206. In one embodiment, each knife 104 is made of machined iron tool steel. The skilled addressee will appreciate that various alternative embodiments may be provided.

When the knife 104 is positioned in the knife pocket 118 (best shown in FIGS. 10A and 10B), the connection portion 190 of the knife 104 is received in the knife pocket 118, and the cutting edge 206 extends outwardly from the body 102. The cutting edges 206 of the knives 104 are disposed so that they face a same forward direction to effectively cut an outside layer of the wood lumbers (not shown) when the planer head 100 is rotated about the axis $R_1$.

Turning now to FIGS. 8 to 11B, the assembly of the planer head 100 now will be described. In a first step, the knives 104 and knife holders 106 are positioned in the knife pockets 118, one knife 104 and one knife holder 106 being received in a corresponding knife pocket 118. A longitudinal member 193 is then inserted into the bore 160. The protrusions 186 fit through holes 189 in the body 102 and into cuneal slots 191 in the longitudinal member 193. The cuneal slots 191 are tapered so that as the nut 195 is tightened onto the longitudinal member 193, the protrusions 186 are pushed upwards securing the knife holder 106 against the knife 104. With tightening of the nut 195, the knife 104 is therefore frictionally engaged and secured. This step is repeated until all parts are in place. At this point, the planer head 100 can be operated.

While in the above-described embodiment the leading and trailing faces 198, 200, 172, 178, 140 and 142 of the knives 104, knife holders 106 and knife retaining members 138 are generally flat, it is contemplated that at least some of them could be scalloped to increase frictional engagement. Additionally, although in this embodiment the protrusions 186 are circular, it is conceivable that they be of another suitable shape (e.g. rectangular).

Modifications and improvements to the above-described embodiments of the present may become apparent to those skilled in the art. For instance, it should be understood that the planer heads described herein could be positioned in a horizontal position, vertical position, or any angled position between a vertical position and an horizontal position to smoothen a given surface of a lumber. It should also be understood that the planer heads described herein are not limited to be used with wood lumbers, but could be used with any other surface which may require smoothing and for which the rotational cutting of an external layer of that surface would be appropriate. Likewise, the embodiments described herein could find use in a cutter head provided with removable knives other than planer heads.

We claim:

1. A planer head comprising:

a cylindrical body having a rotational axis, the cylindrical body including at least one knife pocket on the periphery of the body having a first wall, a second wall and a bottom wall, the cylindrical body further including at least one bore extending parallel to the rotational axis, and at least one hole extending between the bottom wall of the pocket and the at least one bore, at least one knife holder having a first wall, a second wall adjacent to the second wall of the knife pocket, a bottom wall, and at least one protrusion projecting away from the bottom wall of the at least one knife holder, the at least one protrusion being configured to engage the at least one hole of the cylindrical body and to partially extend into the bore, the knife holder being moveable in the knife pocket between a radially inward position and a radially outward position, at least one knife received in the knife pocket of the cylindrical body, the at least one knife having a first wall adjacent to the first wall of the at least one knife pocket, a second wall adjacent the first wall of the at least one knife holder and a cutting edge extending radially away from the knife pocket, and a fastening assembly for fastening the at least one knife holder to the cylindrical body, the fastening assembly including a longitudinal member and a fastening means, the longitudinal member being sized and shaped to fit within the bore of the cylindrical body and including a first end, a second end and at least one slot located between the first end and the second end, the at least one slot being shaped to interact with the at least one protrusion of the knife holder extending in the bore of the cylindrical body, the fastening means of the fastening assembly engaging the first end of the longitudinal member to force the longitudinal member from a released position toward a locked position, wherein when the longitudinal member is forced from the released position toward the locked position, the at least one slot of the longitudinal member engages the at least one protrusion of the knife holder to urge movement of knife holder from the radially inward position to the radially outward position, wherein the knife holder in the radially outward position secures the at least one knife to the cylindrical body.

2. A planer head according to claim 1, wherein the at least one protrusion comprises a first end adjacent the bottom wall of the knife holder and a second end extending into the at least one bore of the cylindrical body.

3. A planer head according to claim 2, wherein the second end of the at least one protrusion comprises a tapered end.

4. A planer head according to claim 2, wherein the second end of at least one protrusion comprises a parabolically shaped end.

5. A planer head according to claim 1, wherein the cylindrical body comprises three holes extending between the bottom wall of the at least one knife pocket and the bore, wherein the knife holder comprises three protrusions configured to engage the three holes of the cylindrical body and to partially extend into the bore, and wherein the longitudinal member comprises three slots configured to engage the three protrusions extending in the bore of the cylindrical body.

6. A planer head according to claim 5, wherein the cylindrical body further comprises a mounting hole for mounting the body to a rotating shaft, the mounting hole extending along the rotational axis at a center of the cylindrical body.

7. A planer head according to claim 6, wherein the longitudinal member comprises a body and a threaded portion extending at the first end of the longitudinal member, and wherein the fastening means comprises a nut engaging the threaded portion of the longitudinal member.

8. A planer head according to claim 7, wherein the bore of the cylindrical body comprises a first end, a second end and a circular recess at the first end of the bore, the circular recess of the bore receiving the threaded portion of the longitudinal member and the nut engaging the threaded portion.

9. A planer head according to claim 8, wherein the body of the longitudinal member has a first longitudinal axis, and the threaded portion of the longitudinal member has a second longitudinal axis, the second longitudinal axis of the threaded portion being offset in a radial direction from the first longitudinal axis of the body.

10. A planer head according to claim 9, wherein the bore has a third longitudinal axis and the circular recess has a fourth longitudinal axis, the fourth longitudinal axis the circular recess being offset relative to the third longitudinal axis of the bore in a radial direction, wherein when the longitudinal member is positioned in the bore, the second longitudinal axis of the threaded portion of the longitudinal member aligns with the fourth longitudinal axis of the circular recess.

11. A planer head according to claim 8, wherein the longitudinal member further comprises a flange extending radially at the second end thereof.

12. A planer head according to claim 11, wherein the bore of the cylindrical body further comprises a second recess at the second end of the bore, the second recess of the bore receiving therein the flange extending at the second end of the longitudinal member.

13. A planer head according to claim 12, wherein the flange at the second end of the elongated member and the second recess at the second end of the bore have an oblong shape.

14. A planner head according to claim 1, wherein the planer head comprises between 20 and 40 knife pockets and a corresponding number of knives and knife holders.

15. A planer head according to claim 14, wherein the planer head comprises 24 knife pockets and a corresponding number of knives and knife holders.

16. A kit of a planer head assembly comprising:

a cylindrical body having a rotational axis, the cylindrical body including at least one knife pocket on the periphery of the body having a first wall, a second wall and a bottom wall, the cylindrical body further including at least one bore extending parallel to the rotational axis, and at least one hole extending between the bottom wall of the pocket and the at least one bore, at least one knife holder having a first wall, a second wall adjacent to the second wall of the knife pocket, a bottom wall, and at least one protrusion projecting away from the bottom wall of the at least one knife holder, the at least one protrusion being configured to engage the at least one hole of the cylindrical body and to partially extend into the bore, the knife holder being moveable in the knife pocket between a radially inward position and a radially outward position, at least one knife received in the knife pocket of the cylindrical body, the at least one knife having a first wall adjacent to the first wall of the at least one knife pocket, a second wall adjacent the first wall of the at least one knife holder and a cutting edge extending radially away from the knife pocket, and a fastening assembly for fastening the at least one knife holder to the cylindrical body, the fastening assembly including a longitudinal member and a fastening means, the longitudinal member being sized and shaped to fit within the bore of the cylindrical body and including a first end, a second end and at least one slot located between the first end and the second end, the at least one slot being shaped to interact with the at least one protrusion of the knife holder extending in the bore of the cylindrical body, the fastening means of the fastening assembly engaging the first end of the longitudinal member to force the longitudinal member from a released position toward a locked position, wherein when the longitudinal member is forced from the released position toward the locked position, the at least one slot of the longitudinal member engages the at least one protrusion of the knife holder to urge movement of knife holder from the radially inward position to the radially outward position, wherein the knife holder in the radially outward position secures the at least one knife to the cylindrical body.

17. A kit of a planer head according to claim 16, wherein the at least one protrusion comprises a first end adjacent the bottom wall of the knife holder and a second end extending into the at least one bore of the cylindrical body.

18. A kit of a planer head according to claim 17, wherein the second end of the at least one protrusion comprises a tapered end.

19. A kit of a planer head according to claim 17, wherein the second end of at least one protrusion comprises a parabolically shaped end.

20. A kit of a planer head according to claim 16, wherein the cylindrical body comprises three holes extending between the bottom wall of the at least one knife pocket and the bore, wherein the knife holder comprises three protrusions configured to engage the three holes of the cylindrical body and to partially extend into the bore, and wherein the longitudinal member comprises three slots configured to engage the three protrusions extending in the bore of the cylindrical body.

21. A kit of a planer head according to claim 20, wherein the cylindrical body further comprises a mounting hole for mounting the body to a rotating shaft, the mounting hole extending along the rotational axis at a center of the cylindrical body.

22. A kit of a planer head according to claim 21, wherein the longitudinal member comprises a body and a threaded portion extending at the first end of the longitudinal member, and wherein the fastening means comprises a nut engaging the threaded portion of the longitudinal member.

23. A kit of a planer head according to claim 22, wherein the bore of the cylindrical body comprises a first end, a second end and a circular recess at the first end of the bore, the circular recess of the bore receiving the threaded portion of the longitudinal member and the nut engaging the threaded portion.

24. A kit of a planer head according to claim 23, wherein the body of the longitudinal member has a first longitudinal axis, and the threaded portion of the longitudinal member has a second longitudinal axis, the second longitudinal axis of the threaded portion being offset in a radial direction from the first longitudinal axis of the body.

25. A kit of a planer head according to claim 24, wherein the bore has a third longitudinal axis and the circular recess has a fourth longitudinal axis, the fourth longitudinal axis the circular recess being offset relative to the third longitudinal axis of the bore in a radial direction, wherein when the longitudinal member is positioned in the bore, the second longitudinal axis of the threaded portion of the longitudinal member aligns with the fourth longitudinal axis of the circular recess.

26. A kit of a planer head according to claim 23, wherein the longitudinal member further comprises a flange extending radially at the second end thereof.

27. A kit of a planer head according to claim 26, wherein the bore of the cylindrical body further comprises a second recess at the second end of the bore, the second recess of the bore receiving therein the flange extending at the second end of the longitudinal member.

28. A kit of a planer head according to claim 27, wherein the flange at the second end of the elongated member and the second recess at the second end of the bore have an oblong shape.

29. A kit of a planner head according to claim 16, wherein the planer head comprises between 20 and 40 knife pockets and a corresponding number of knives and knife holders.

30. A kit of a planer head according to claim 29, wherein the planer head comprises 24 knife pockets and a corresponding number of knives and knife holders.

* * * * *